US009478895B2

(12) United States Patent
Lappoehn

(10) Patent No.: US 9,478,895 B2
(45) Date of Patent: Oct. 25, 2016

(54) PLUG-IN CONNECTOR ARRANGEMENT

(71) Applicant: ERNI Production GmbH & Co. KG, Adelberg (DE)

(72) Inventor: Juergen Lappoehn, Gammelshausen (DE)

(73) Assignee: ERNI Production GmbH & Co. KG, Adelberg (DE)

( * ) Notice: Subject to any disclaimer, the term of this patent is extended or adjusted under 35 U.S.C. 154(b) by 0 days.

(21) Appl. No.: 14/654,056

(22) PCT Filed: Dec. 12, 2013

(86) PCT No.: PCT/DE2013/000775
§ 371 (c)(1),
(2) Date: Jun. 19, 2015

(87) PCT Pub. No.: WO2014/094706
PCT Pub. Date: Jun. 26, 2014

(65) Prior Publication Data

US 2015/0349451 A1 Dec. 3, 2015

(30) Foreign Application Priority Data

Dec. 21, 2012 (DE) ..... 10 2012 025 107

(51) Int. Cl.
*H01R 13/506* (2006.01)
*H01R 13/627* (2006.01)
*H01R 13/64* (2006.01)

(52) U.S. Cl.
CPC ..... *H01R 13/506* (2013.01); *H01R 13/6272* (2013.01); *H01R 13/64* (2013.01)

(58) Field of Classification Search
CPC ... H01R 13/506; H01R 13/508; H01R 13/64
See application file for complete search history.

(56) References Cited

U.S. PATENT DOCUMENTS

| | | | |
|---|---|---|---|
| 6,827,596 | B2 | 12/2004 | Hori |
| 7,201,601 | B2 | 4/2007 | Lappöhn |
| 2002/0106167 | A1 | 8/2002 | Nishita |

FOREIGN PATENT DOCUMENTS

| | | | |
|---|---|---|---|
| DE | 10 2004 054 203 | A1 | 5/2006 |
| DE | 10 2008 051 589 | A1 | 4/2009 |
| DE | 20 2011 000 739 | U1 | 7/2012 |
| EP | 2 302 745 | A1 | 3/2011 |

OTHER PUBLICATIONS

International Search Report of PCT/DE2013/000775, mailed Apr. 22, 2014.

German Office Action in 10 2012 025 107.6, dated Jul. 31, 2013, with English translation of relevant parts.

*Primary Examiner* — Briggitte R Hammond
(74) *Attorney, Agent, or Firm* — Collard & Roe, P.C.

(57) ABSTRACT

A plug-in connector arrangement includes two plug-in connector parts which can be plugged into each another and which each have a housing part, the housing parts being adapted to each another, and a plug contact provided therein, the plug contacts being adapted to each another, wherein the two housing parts have detent elements for detachably connecting the two housing parts to each other. The detent elements include at least one detent tongue that has a detent lug and is arranged in a tongue-receiving pocket in the first housing part, the detent lug engaging in an opening provided therefor in a housing wall of the second housing part, and the tongue-receiving pocket in the first housing part is in the form of a groove that has a substantially U-shaped cross-section, the two lateral limbs of the U projecting beyond the detent tongue.

6 Claims, 4 Drawing Sheets

PLUG-IN CONNECTOR ARRANGEMENT

CROSS REFERENCE TO RELATED APPLICATIONS

This application is the National Stage of PCT/DE2013/000775 filed on Dec. 12, 2013, which claims priority under 35 U.S.C. §119 of German Application No. 10 2012 025 107.6 filed on Dec. 21, 2012, the disclosure of which is incorporated by reference. The international application under PCT article 21(2) was not published in English.

The invention relates to a plug-in connector arrangement, comprising two intermateable plug-in connector parts according to claim 1.

STATE OF THE ART

Such plug-in connector arrangements exist in different designs. What is known from DE 10 2004 054 203 A1 is an insulation-displacement connector plug contact strip for electrical plug-in connectors, comprising combined connection elements which form an insulation-displacement connector area for a stripping-free connection of electrical conductors at one end, and form a plug contact area for a plug contact mating bar at the other end, wherein flat, slotted insulation-displacement connectors are supported on the insulation-displacement connector area. The connection elements are formed in such a manner that the insulation-displacement connectors of these connection elements lie in multiple rows in the insulation-displacement cable connector for a row of plug contacts of the connection elements that are embedded next to each other. Both plug-in connector parts are interlocked by means of a catch that is formed in a spring-like manner and that meshes with a locking slit in the locked state of the two plug-in connector parts. In this plug-in connector arrangement, the catch is arranged at the top side of the housing so as to be mostly exposed.

From DE 20 2011 000 739 U1, a plug-in connection arrangement for electrical conductors has become known, comprising a plug with at least one tunnel, a socket with at least one snap-in tongue, wherein the at least one snap-in tongue with the at least one tunnel of the plug is provided for a combined locking effect in a mated state of the plug-in connection arrangement, as well as at least one cover section that is attached at the plug and that forms a protection of the at least one snap-in tongue against any manual action and against any actuation by a tool in the state in which it comes to the combined locking effect. In this plug-in connection arrangement, the tongue is mostly protected in the locked state, as it lies inside the tunnel provided for it. However, in the unlocked state, the tongue protrudes freely from the socket, thus being easily exposed to damage.

From DE 10 2008 051 589 A1, a coupler and a plug of a plug-in connection with Koshiri security have become known, in which the coupler housing has a protruding spring shackle that comprises a ledge in the area of its free end. The coupler housing and the spring shackle form a one-piece structural component. The spring shackle meshes with a corresponding opening which is adjusted to it of the corresponding other plug-in connector part. Also in this case, the spring shackle—even though it is formed as an integral part of the coupler housing—protrudes from the coupler housing and thus can be damaged if handled in an unfavorable manner.

DISCLOSURE OF THE INVENTION

Advantages of the Invention

In contrast, the plug-in connector arrangement according to the invention has the advantage that the snap-in elements comprise at least one snap-in tongue with a snap-in nose that is arranged in the first housing part inside a tongue receiving pocket, wherein the snap-in nose meshes with an opening provided for it inside a housing wall of the second housing part, and that the tongue receiving pocket in the first housing part is formed in the shape of a groove with a substantially U-shaped cross-section, wherein the two lateral U-legs protrude beyond the tongue. With the two lateral U-legs protruding in this manner, a particularly effective protection of the tongue is facilitated, as the tongue that is positioned between the two U-legs cannot readily be "bent outward", for example.

Advantageous further developments and enhancements of the plug-in connector arrangement that is indicated in the independent claim are the subject matter of the dependent claims. Thus, on the plug side, the two U-legs preferably and particularly advantageously reach up to the front side of the one housing part. Thanks to this arrangement, Koshiri security is particularly advantageously facilitated. That is to say, the two U-legs, reaching up to the front side of the plug and laterally protruding beyond the tongue arranged in between them, do not only protect the tongue in the unlocked state of the plug-in connector arrangement, but they also very effectively prevent any mismating or any canted plug-in of the two plug-in connector parts, which may result in damage to the contact elements arranged therein.

Advantageously, guide grooves for the two U-legs are provided in the second housing part.

Moreover, these guide grooves also reach up to the front side of the second housing part in a very advantageous manner. As far as Koshiri security is concerned, these two guide grooves that reach up to the front side of the second housing part are, as it were, the counterpart of the two U-legs. They, too, do not only prevent any mismating, but in particular also prevent any canted mating, which may result in damage to the contact elements.

At the same time, together with the two U-legs as well as the U-shaped grooves in the mated state of the two plug-in connector parts, the guide grooves limit the tongue receiving pocket in the second plug-in connector part, thus forming the tongue receiving pocket inside of which the tongue comes to rest in the mated state of the two plug-in connector parts.

The tongue is advantageously formed in a spring-like manner and is advantageously formed as an integral part of one of the two housing parts.

The snap-in nose that is arranged thereon advantageously comprises a chamfer on the plug side, which facilitates the sliding of the snap-in nose into the opening in the second housing part provided for that purpose.

SHORT DESCRIPTION OF THE DRAWINGS

Exemplary embodiments of the invention are shown in the drawings and are explained in more detail in the following description.

Herein:

EMBODIMENTS OF THE INVENTION

Figure 1:
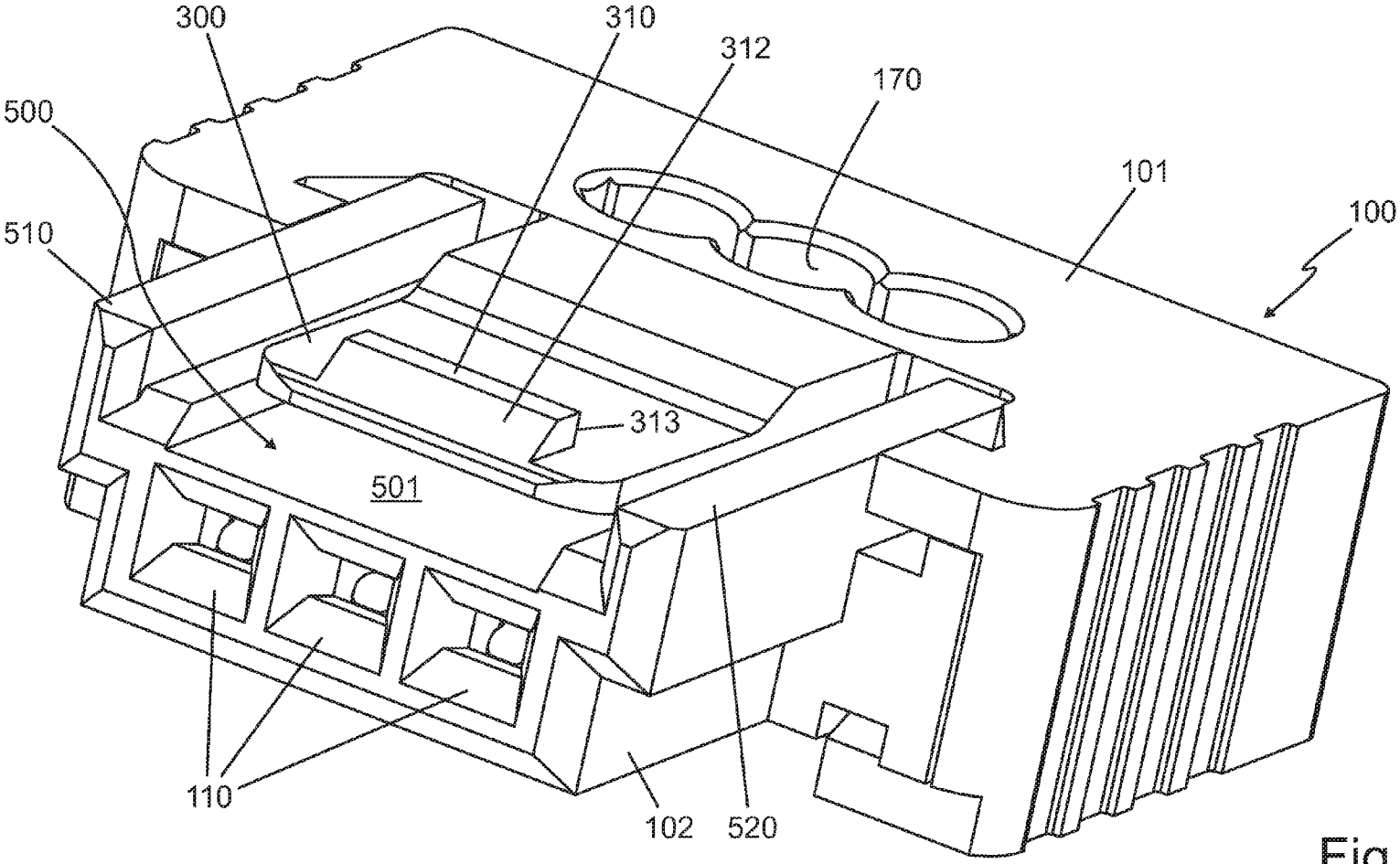
FIG. 1 shows an isometric rendering of the first housing part of a plug-in connector arrangement according to the invention.
Figure 2:
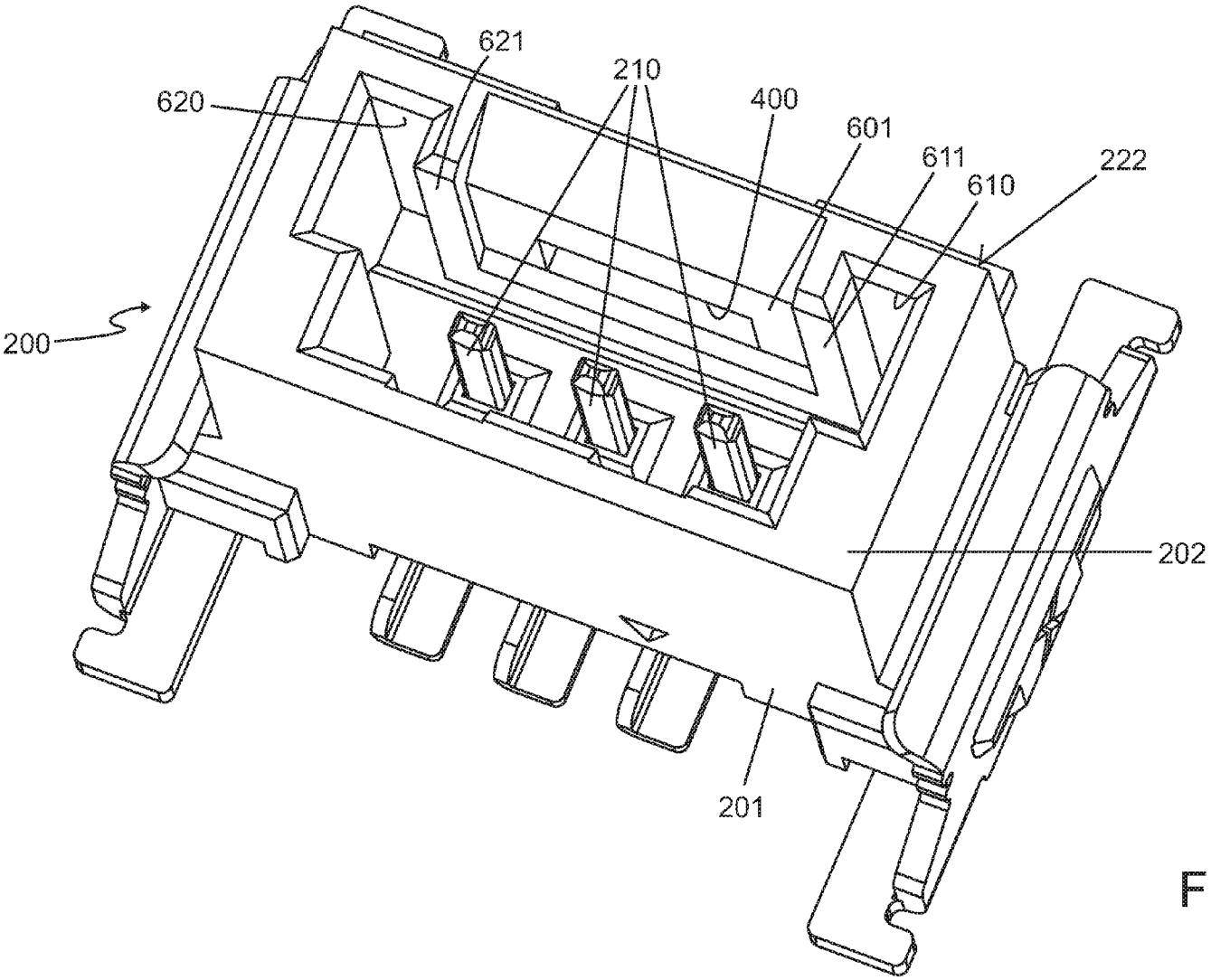
FIG. 2 shows an isometric rendering of the second housing part of the plug-in connector arrangement according to the invention in a diagonal top view.
Figure 3:
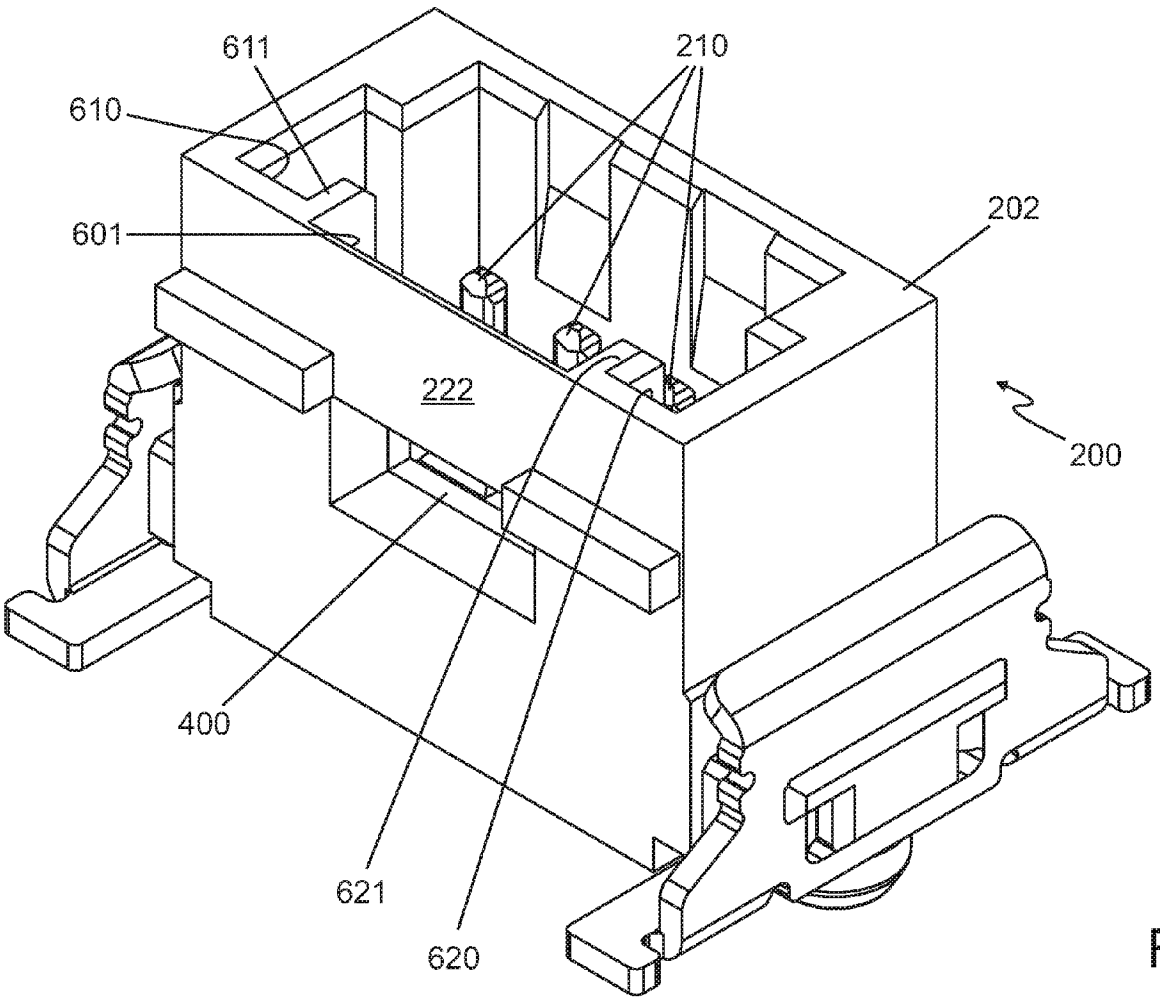
FIG. 3 shows an isometric rendering of the second housing part of the plug-in connector arrangement according to the invention in another view and FIG. 4 shows an isometric rendering of the first housing part and the second housing part in a mated state.

A plug-in connector arrangement shown in FIG. 1, FIG. 2 and FIG. 3 comprises two plug-in connector parts 100, 200. The one plug-in connector part 100 can be formed as a female multipoint connector, for example, whereas the other plug-in connector part 200 is formed as a multipole plug-in connector, as shown. For this purpose, spring contact elements 110 are provided in a plug-in part 102 of the housing 101 in the plug-in connector part 100 that is formed as a female multipoint connector. In contrast, in a corresponding housing part 202 of the housing 201, knife contact elements 210 are arranged inside the plug-in connector part 200 that is formed as a multipole plug-in connector. The knife contact elements 210 can be plugged into correspondingly adjusted spring contact elements 110 of the plug-in connector part 100.

Figure 4:
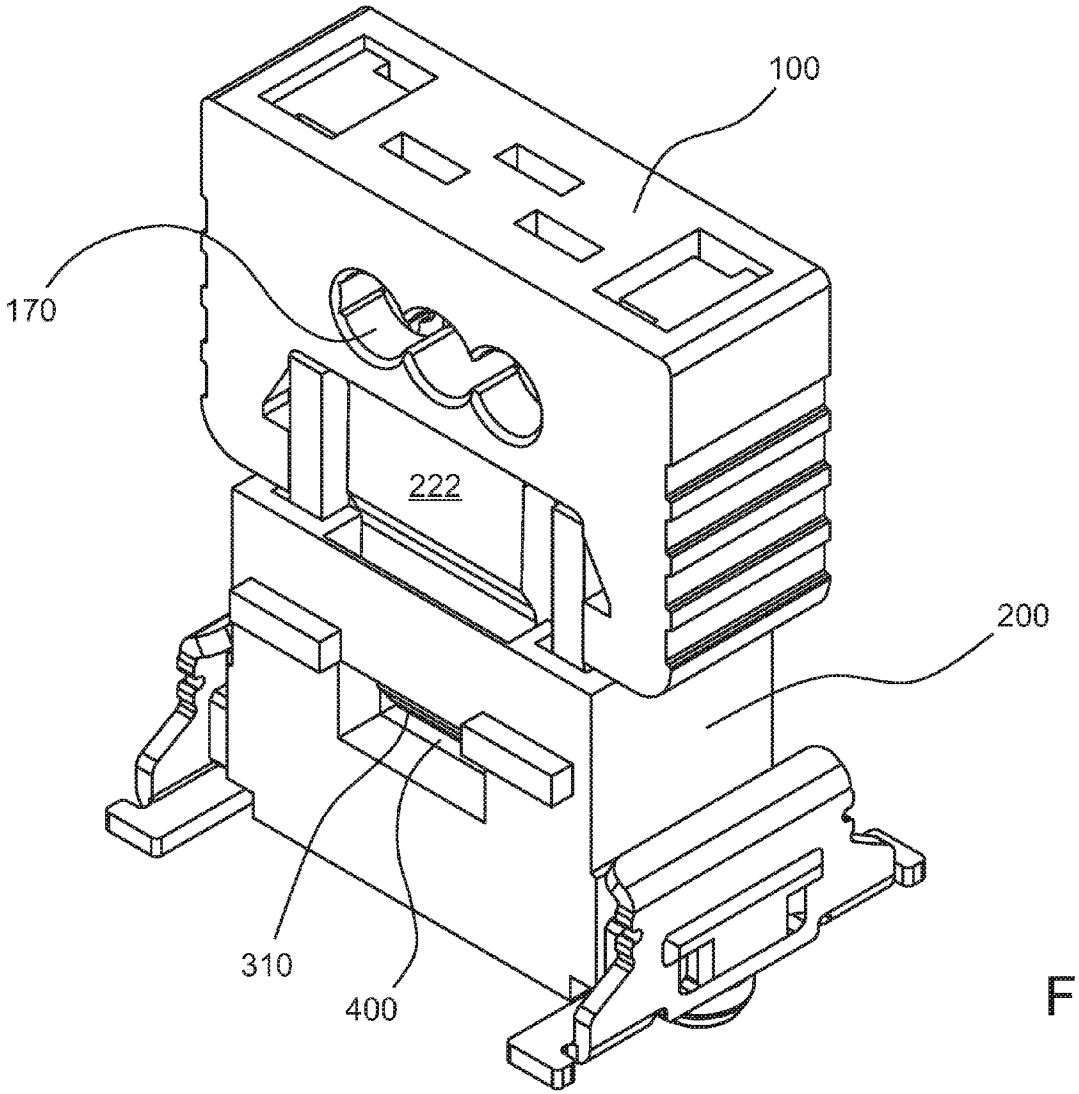

A snap-in tongue 300 (which will also be referred to in short as a "tongue" in the following) comprising a snap-in nose 310 is arranged substantially above and extending parallel to the spring contact elements 110 of the first plug-in connector part 100. In the mating direction, the snap-in nose 310 has a chamfer 312 which facilitates a sliding into an opening 400 that is arranged in the housing 201 of the second plug-in connector part 200 and which is adjusted to the snap-in tongue 300. The snap-in tongue 300 is formed in a spring-like manner, so that it slightly bends in the direction of the spring contact elements 110 when it is inserted into the housing 201 of the second plug-in connector part 200, which is facilitated by the chamfer 312 that acts as a sliding surface, until the snap-in nose 310 has come to lie completely behind the opening 400, abutting with its catch end 313 a housing wall 222 that is receiving the opening 400, as shown in FIG. 4. In this case, the two plug-in connector parts are interlocked and can be pulled apart only by again bending the tongue in the direction of the spring contact elements 110, for example by means of a suitable tool.

The tongue 300 lies in a corresponding receiving pocket 500, which has a substantially U-shaped form, with a surface 501 extending substantially in parallel to the tongue 300 and with lateral U-legs 510, 520. The U-legs 510, 520 protrude beyond the tongue 300, meaning that, in particular also with regard to its height, the tongue 300 lies completely within the U-shaped area, formed by the U-legs 510, 520 and the surface 501, of the quasi first half of the tongue receiving pocket 500 thus created (FIG. 1).

The second plug-in connector part 200 (FIG. 2) has guide grooves 610, 620, which serve for guiding the two U-shaped legs 510, 520. In this manner, a very precise and reverse-polarity-protected mating of the two plug-in connector parts is possible.

In the mated state of the two plug-in connector parts 100, 200, the tongue 300 lies within the two housing parts, wherein the tongue receiving pocket 500 is formed by the U-shaped area of the first plug-in connector part 100 as well as the two guide grooves 610, 620 of the second plug-in connector part 200 in connection with a surface 601 (FIG. 2) that is slightly set back with respect to the two groove webs 611, 621. In the mated state of the two plug-in connector parts 100, 200, the two groove webs 611, 621 form the tongue receiving pocket 500 together with the surface 601 as well as with the two U-legs 510, 520 and the surface 501, with the snap-in tongue 300 being arranged inside that tongue receiving pocket 500 in a fully protected manner.

However, at the same time the two U-shaped legs 510, 520 fulfill another very important function in connection with the two grooves 610, 620 and the corresponding groove legs 611, 621, which will be explained in more detail below.

The two U-legs 510, 520 as well as the two groove legs 611, 621 reach up to the front side of the respective housing parts of the two plug-in connector parts 100, 200. They are formed to be comparatively massive and, due to their design, do not only prevent any mismating, but in particular also prevent any canted mating of the two plug-in connector parts 100, 200. In other words, they also serve for providing the so-called Koshiri security. This Koshiri security is achieved not only by means of the U-legs 510, 520 that respectively reach up to the front sides of the plug-in connector parts, and the groove legs 611, 621, but also by virtue of the fact that the contact elements 110 or 210 are set back with respect to the front side of the two plug-in connector parts 100, 200, and in particular that they are set back with respect to the two U-legs 510, 520 and the two groove legs 611, 621. Through this set-back arrangement of the plug contacts in connection with the massive U-shaped legs 510, 520 and the groove legs 611, 621 that are forming the grooves 610, 620 and that both reach up to the front side of the housing of the plug-in connector parts 100, 200, respectively, any canted mating, which may lead to damage to the contact elements, is effectively prevented. At the same time, as a synergistic effect is being created, a tongue receiving pocket 500 is formed through the arrangement and the combined effect of the U-shaped legs 510, 520 and the grooves 610, 620 in connection with the surface 501 as well as with the set back surface 601, which effectively protects the tongue 300 not only in the locked state, but in particular also in the state in which the two plug-in connector parts 100, 200 are not interlocked.

Thus, the U-shaped legs 510, 520 together with the surface 501, as well as the grooves 610, 620 together with the groove legs 611, 621 and the set back surface 601 do not only facilitate the formation of a tongue receiving pocket 500, but at the same time also ensure the Koshiri security of the plug.

In conclusion it should be stated that the plug-in connection arrangement shown in FIG. 1 to FIG. 3 comprises a plug-in connection part 200, which is arranged on a printed circuit board, for example, and is contacted in that position with correspondingly provided conducting paths, and a plug-in connection part 100, which is contacted with corresponding electrical conductors by means of per se known insulation-displacement contacts, for example. For this purpose, openings 170 are provided, into which a flat ribbon cable or individual wires project, for example, which may be contacted in the plug-in connector part 100 in the manner described in DE 10 2004 054 203 A1 by means of insulation-displacement connectors, for example.

The invention claimed is:

1. A plug-in connector arrangement comprising a first plug-in connector part and a second plug-in connector part intermateable with the first plug-in connector part in a mating direction, the first plug-in connector part having a first housing part having first plug contacts inside the first plug-in connector part, the second plug-in connector part having a second housing part having second plug contacts inside the second plug-in connector part, the second plug contacts being mateable with the first plug contacts, wherein the first and second housing parts have snap-in elements for releasable interlocking of the first and second housing parts, wherein the snap-in elements comprise at least one snap-in tongue with a snap-in nose in the first housing part, the snap-in nose meshing with an opening provided for the snap-in nose in a housing wall of the second housing part, wherein a tongue receiving pocket in the first housing part is formed in a groove-shaped manner with a substantially U-shaped cross-section and comprises two lateral U-legs protruding in an upwards direction, the upwards direction being perpendicular to the mating direction, wherein the two lateral U-legs protrude in the upwards direction beyond the snap-in tongue such that the snap-in tongue is arranged within the tongue receiving pocket, wherein guide grooves are provided in the second housing part for both of the two lateral U-legs, respectively, wherein the guide grooves and a set-back surface arranged between the guide grooves limit the tongue receiving pocket in the second plug-in connector part in a mated state of the first and second plug-in connector parts, and wherein inside the tongue receiving pocket the snap-in tongue comes to rest in the mated state of the first and second plug-in connector parts.

2. The plug-in connector arrangement according to claim 1, wherein the two lateral U-legs extend in the mating direction to a front side of the first housing part on a plug side of the first housing part.

3. The plug-in connector arrangement according to claim 1, wherein the guide grooves extend in the mating direction to a front side of the second housing part.

4. The plug-in connector arrangement according to claim 1, wherein the snap-in tongue is formed in a spring-like manner.

5. The plug-in connector arrangement according to claim 1, wherein the snap-in tongue is formed at the first housing part as an integral part of the first housing part.

6. The plug-in connector arrangement according to claim 1, wherein the snap-in nose has a chamfer on a plug side of the snap-in nose.

* * * * *